United States Patent [19]

Maier

[11] 4,161,636

[45] Jul. 17, 1979

[54] ARC EXTINGUISHING ARRANGEMENT FOR GAS BLAST TYPE CIRCUIT BREAKER

[75] Inventor: Heribert Maier, Dietikon, Switzerland

[73] Assignee: BBC Brown, Boveri & Company Limited, Baden, Switzerland

[21] Appl. No.: 680,800

[22] Filed: Apr. 27, 1976

[30] Foreign Application Priority Data

Jun. 18, 1975 [CH] Switzerland ..... 7905/75

[51] Int. Cl.[2] ..... H01H 33/88

[52] U.S. Cl. ..... 200/148 A; 200/150 G

[58] Field of Search ..... 200/148 A, 150 G

[56] References Cited

U.S. PATENT DOCUMENTS 3,205,331 9/1965 Thommen et al. ..... 200/150 G 3,786,215 1/1974 Mauthe ..... 200/150 G 3,824,360 7/1974 Scamecka et al. ..... 200/148 A

*Primary Examiner*—Robert S. Macon

*Attorney, Agent, or Firm*—Burns, Doane, Swecker & Mathis

[57] ABSTRACT

An electrical circuit breaker of the gas blast type comprises a pair of contact members disposed within an arc quenching zone of a chambered part at which separation of the contact members takes place and an arc is established therebetween. An annular blast gas in-flow duct surrounds the arc quenching zone and through which the gas is forced by piston action in the direction of the quenching zone at the time of contact separation, and the discharge end of this in-flow duct includes a gas deflection zone for preventing blow-back of hot arc extinction gases formed in the quenching zone through the in-flow duct in the opposite direction thereby minimizing the chances of damage to the piston system.

9 Claims, 1 Drawing Figure

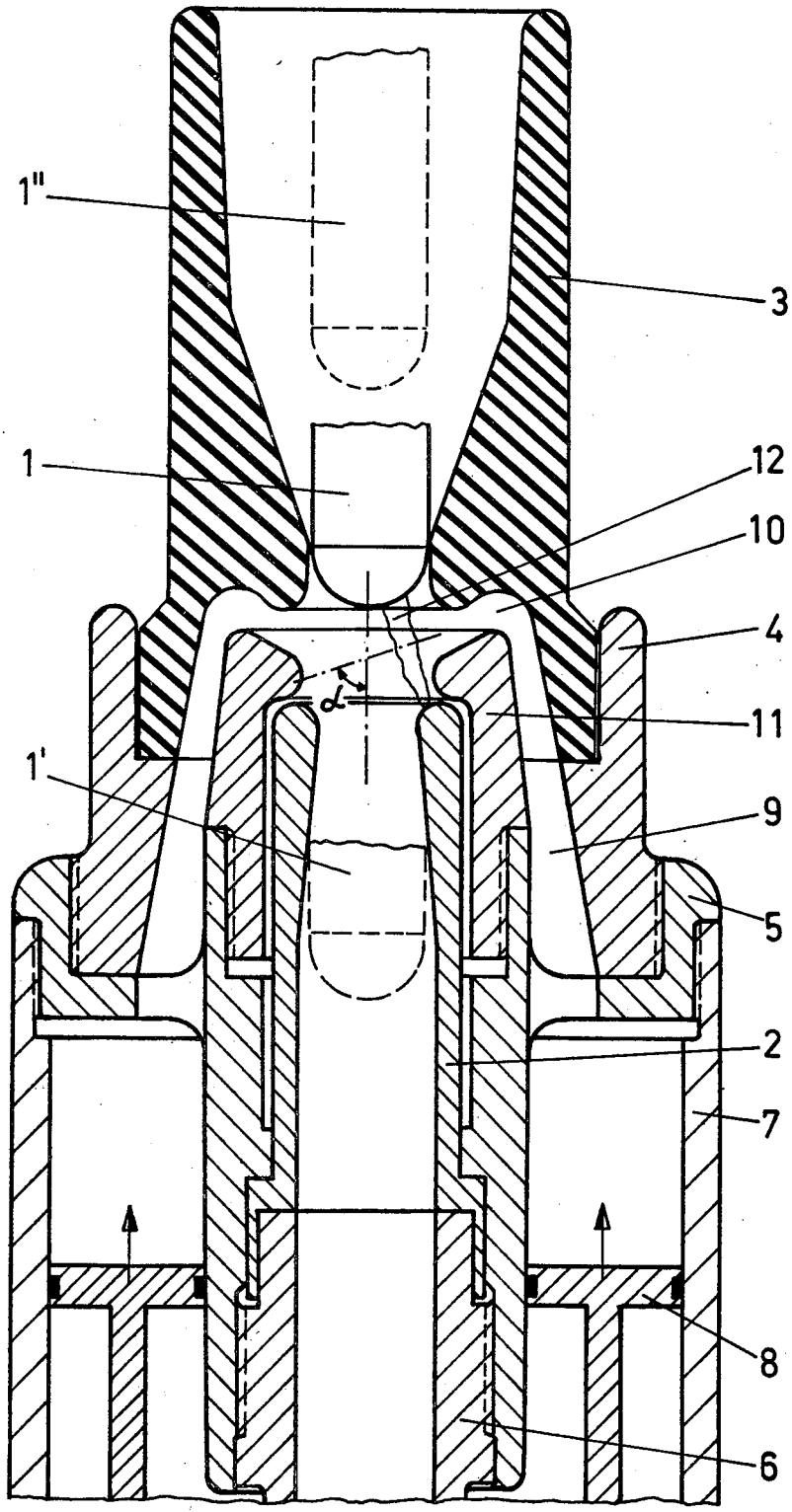
1"
3
1
12
10
4
α
11
1'
9
5
2
7
8
6

ARC EXTINGUISHING ARRANGEMENT FOR GAS BLAST TYPE CIRCUIT BREAKER

This invention relates to an improved construction for electrical circuit breakers of the type wherein the zone within a chambered part of the breaker at which contact separation takes place and an arc is temporarily formed between the contacts, the so-called arc quenching zone, is blasted with a gas such as $SF_6$ in order to extinguish the arc. More specifically the invention relates to a circuit breaker of this general type wherein the blasting effect of the gas is produced by piston action at the contact chamber. A circuit breaker of this type is disclosed in a published German patent application DT-OS No. 2,316,009 wherein one or more non-return, i.e. one-way valves are incorporated in annular ducts in the path of the gas flow to protect the piston-system against gas blow-backs from the arc quenching zone.

The general object of this invention is to provide similar protection for the piston-system but without the necessity for interposing non-return valves in the gas flow path. The disadvantage of using non-return valves is that valve operation can often be impaired due to the high thermal stresses which are imposed upon them by the arc which is relatively near to them.

The objective of the invention is attained by provision of a gas deflection zone within the gas flow duct leading to the quenching zone and which serves to practically eliminate any danger of the undesirable blow-back of the very hot arc extinction gases to the piston-system. The novel arrangement has the additional advantage in the desired protection against blow-back is accomplished in a most simple yet highly effective manner.

The foregoing as well as other objects and advantages inherent in the invention will become more apparent from the following detailed description of a preferred embodiment and the accompanying drawing, the single view of which shows only the arc extinction chamber portion of the circuit breaker in longitudinal central section. Other structural details thereof, which are conventional have not been included in order to simplify the presentation.

The circuit breaker includes two contacts which are arranged to be brought together, or separated respectively in order to close or open the electrical circuit, respectively that is controlled by the breaker. The specific embodiment illustrated includes a movable contact member in the form of a pin which is mounted for movement longitudinally within a tubular nozzle-shaped member 3 made of insulation material, and a stationary contact member 2 having a springy tulip-shaped configuration which permits entry of the contact pin. Numeral 1 indicates the position of the contact pin at the beginning of the arc-extinguishing process, it having been separated from the tulip contact 2 and drawing an arc 12. Numeral 1' indicates the position of the contact pin when fully inserted in the tulip contact, and numeral 1'' the contact pin position when the separation stroke has been completed.

The insulation nozzle member 3 is seated in a recess provided in the upper part of an annular metallic support member 4, and the lower part of the latter is externally threaded for a screwed-in connection to a threaded recess provided in another annular metallic support part 5. The tulip-shaped contact member 2 is mounted within a central through bore provided in the support part 5, being connected at its lower end to a tubular part 6 to which the lower part of the support member 5 is also connected, and an annular auxiliary, metallic nozzle member 11 includes a lower male threaded portion which is screwed into a threaded recess provided in the central part of the support member 5. The mouth of the auxiliary nozzle 11 extends beyond the end of the tulip-shaped contact 2 and is axially spaced from the mouth of nozzle 3. A cylinder 7 includes a threaded internal surface at its upper end which is screwed onto an externally threaded lower portion of the support part 5 and accommodates an annular piston 8 which is axially guided at its inner periphery on a lower cylindrical portion of the support part 5. The piston space within cylinder 7 terminates in an annular gas in-flow duct 9 which is formed in part between the outer periphery of auxiliary nozzle 11 and inner peripheral surface portions of the annular support part 4 and the adjacent nozzle member 3. The gas exit end of the annular in-flow duct 9 terminates in a curved wall, ring-shaped deflection zone 10 in which the gas is forced to make a sharp turn in order to enter the arc extinction zone formed between the contact members 1,2 in a radially inward direction. The radially inward directed flow of the quenching gas forms an acute angle $\alpha$ with the movement axis of the contact pin 1, the angle $\alpha$ preferably being within the range of from 45° to 60°.

The operation of the circuit breaker is as follows:

In order to break the electrical circuit, the contact pin is withdrawn from its switched-in position 1' by means of a conventional drive, not illustrated, with piston 8 being moved at the same time in its cylinder in the same direction, as indicated by the arrow. When contact pin 1 separates from the tulip contact member 2, the arc 12 is generated. Within the region of the arc current maximum, a relatively strong pressure is built up within the quenching zone and this zone is filled, to a large extent, by the arc. However, due to the presence of the novel deflection zone 10 at the point of entry into the annular in-flow duct 9, any blow-back of hot arc extinction gas through this duct is for all practical purposes prevented thereby protecting the piston system against any possible damage. Moreover, the auxiliary nozzle 11 will provide an efficient blast-action, and will furthermore protect the in-flow duct 9 against entry of any metallic particles burned off the surfaces of the contact members 1,2, the formation of which cannot always be avoided even if metallic materials resistant to burning are used.

The improved circuit breaker structure is not to be regarded as being restricted to the specific embodiment illustrated. Obviously, it is only necessary that relative movement take place between the contact members 1 and 2. Thus, in a obvious alternative construction, contact pin 1 and piston 8 could remain stationary and the other switch parts made to be movable in an axial direction.

I claim:

1. In an electrical circuit breaker of the gas blast type comprising a pair of contact members disposed within an arc quenching zone of a chambered part at which separation of the contact members takes place and an arc is established therebetween, the improvement wherein an annular blast gas in-flow duct surrounds said arc quenching zone and through which the gas is forced by piston action in the direction of said quenching zone, and the discharge end of said in-flow duct includes a gas deflection zone constituted by a fixed ring-shaped duct which lies at an acute angle to the axis of the quenching zone, said angle being in the range of from 45° to 60° for preventing blow-back of hot arc extinction gases formed in the quenching zone through said in-flow duct in the opposite direction.

2. An electrical circuit breaker of the gas blast type as defined in claim 1 wherein said ring-shaped gas deflection duct is established between confronting surfaces of a nozzle through which one contact member passes and an auxiliary nozzle surrounding the other contact member.

3. In an electrical circuit breaker of the gas blast type having a pair of contact members, means mounting said contact members for movement along a common axis into and out of contact with each other, an arc quenching zone adjacent said contact members when in contact with each other, duct means surrounding said arc quenching zone, and means for pumping gas through said duct means to quench an arc in said arc quenching zone, the improvement comprising:

a fixed deflection zone in said duct means, said deflection zone including an annular wall for directing gas toward said common axis at an acute angle with respect to said common axis and transverse to the arc drawn upon separation of said contact members.

4. The electrical circuit breaker of claim 3 wherein said duct means is tapered to provide acceleration of the flow of gas therethrough.

5. In an electrical circuit breaker of the gas blast type having a pair of contact members, means mounting said contact members for movement along a common axis into and out of contact with each other, an arc quenching zone adjacent said contact members when in contact with each other, duct means surrounding said arc quenching zone, and means for pumping gas through said duct means to quench an arc in said arc quenching zone, the improvement comprising:

a deflection zone in said duct means, said deflection zone including an annular wall for directing gas toward said common axis at an acute angle with respect to said common axis and transverse to the arc drawn upon separation of said contact members; and said duct means being defined by first and second nozzle members, said first nozzle member being annular and made of an insulating material, said second nozzle member being annular and located radially within said first nozzle member at a distance spaced therefrom to define said duct means.

6. The electrical circuit breaker of claim 5 wherein said first and second nozzle members are stationary with respect to each other.

7. The electrical circuit breaker of claim 5 wherein one of said contact members includes an annular member located radially within said second nozzle member.

8. The electrical circuit breaker of claim 7 wherein the other contact member is a plunger contact member which is adapted to move along said common axis into an aperture in said one contact member to make contact therewith.

9. The electrical circuit breaker of claim 5 wherein said first nozzle member includes a curved portion, and said second nozzle member includes a curved surface which cooperates with said curved portion of said first nozzle member to define said deflection zone.

* * * * *